US009153881B2

(12) United States Patent
Vanzetto

(10) Patent No.: US 9,153,881 B2
(45) Date of Patent: Oct. 6, 2015

(54) FLEXIBLE TUNNEL FOR A CONNECTION TERMINAL AND TERMINAL COMPRISING ONE SUCH TUNNEL

(71) Applicant: Schneider Electric Industries SAS, Rueil Malmaison (FR)

(72) Inventor: Daniel Vanzetto, Claix (FR)

(73) Assignee: SCHNEIDER ELECTRIC INDUSTRIES SAS, Rueil-Malmaison (FR)

( * ) Notice: Subject to any disclaimer, the term of this patent is extended or adjusted under 35 U.S.C. 154(b) by 119 days.

(21) Appl. No.: 13/963,114

(22) Filed: Aug. 9, 2013

(65) Prior Publication Data

US 2014/0113507 A1 Apr. 24, 2014

(30) Foreign Application Priority Data

Oct. 23, 2012 (FR) ..... 12 60074

(51) Int. Cl.
*H01R 4/36* (2006.01)
*H01R 4/30* (2006.01)
*H01R 9/24* (2006.01)

(52) U.S. Cl.
CPC ..... *H01R 4/366* (2013.01); *H01R 4/304* (2013.01); *H01R 4/36* (2013.01); *H01R 9/24* (2013.01)

(58) Field of Classification Search
CPC ..... H01R 4/363; H01R 4/366; H01R 4/36; H01R 4/32; H01R 4/301
USPC ..... 439/812, 810, 811
See application file for complete search history.

(56) References Cited

U.S. PATENT DOCUMENTS

| | | | | | |
|---|---|---|---|---|---|
| 2,161,249 | A | * | 6/1939 | Dibner | 439/812 |
| 2,205,322 | A | * | 6/1940 | Thomas, Jr. et al. | 439/812 |
| 2,727,220 | A | * | 12/1955 | Buchanan et al. | 439/812 |
| 2,732,535 | A | * | 1/1956 | Hammerly | 439/814 |
| 2,780,793 | A | * | 2/1957 | Gambale | 439/812 |
| 2,907,978 | A | * | 10/1959 | Bergan | 439/811 |

(Continued)

FOREIGN PATENT DOCUMENTS

| | | | |
|---|---|---|---|
| DE | 221 883 | A1 | 5/1985 |
| DE | 195 13 281 | A1 | 10/1996 |

(Continued)

OTHER PUBLICATIONS

French Preliminary Search Report issued Jun. 14, 2013 in French Application 12 60074, filed on Oct. 23, 2012 ( with English Translation of Category of Cited Documents).

*Primary Examiner* — Abdullah Riyami
*Assistant Examiner* — Vladimir Imas
(74) *Attorney, Agent, or Firm* — Oblon, McClelland, Maier & Neustadt, L.L.P.

(57) ABSTRACT

The invention relates to a flexible tunnel for connection terminal, made by cutting and bending a metal strip to form a flexible frame delimiting an opening. Said opening is delimited by a first and a second lateral branch extending parallel to one another from a bottom, the first branch being extended by an upper branch closing the one-piece structure of the tunnel. When the tunnel is in an untightened state, the upper branch through which the clamping screw is intended to pass in a perpendicular manner forms a first angle of deformation with a longitudinal axis of the tunnel parallel to the first and second lateral branches. The bottom forms a second angle of deformation with the longitudinal axis of the tunnel.

13 Claims, 3 Drawing Sheets

(56) References Cited

U.S. PATENT DOCUMENTS

| | | | | | |
|---|---|---|---|---|---|
| 2,938,191 | A * | 5/1960 | Kobryner et al. | 439/812 |
| 2,953,771 | A * | 9/1960 | Kussy | 439/791 |
| 3,075,164 | A * | 1/1963 | Humpage et al. | 439/814 |
| 3,125,398 | A * | 3/1964 | Wolf | 439/798 |
| 3,253,251 | A * | 5/1966 | Norden | 439/716 |
| 3,539,977 | A * | 11/1970 | Woertz | 439/811 |
| 3,638,172 | A * | 1/1972 | Adam | 439/791 |
| 4,103,986 | A * | 8/1978 | Izraeli | 439/811 |
| 4,213,669 | A * | 7/1980 | Wittes et al. | 439/811 |
| 6,572,418 | B2 * | 6/2003 | Takaya et al. | 439/812 |
| 7,172,470 | B2 * | 2/2007 | Takaya et al. | 439/811 |
| 7,540,792 | B2 * | 6/2009 | Ananthakrishnan et al. | 439/811 |
| 7,798,869 | B1 * | 9/2010 | Konopacki et al. | 439/812 |
| 8,191,880 | B2 * | 6/2012 | Oh et al. | 269/287 |
| 8,814,609 | B2 * | 8/2014 | Hausner et al. | 439/834 |
| 2002/0081914 | A1 | 6/2002 | Takaya et al. | |

FOREIGN PATENT DOCUMENTS

| | | |
|---|---|---|
| EP | 0 336 251 A2 | 10/1989 |
| EP | 0 481 309 A2 | 4/1992 |
| EP | 1 085 601 A1 | 3/2001 |
| FR | 2 565 039 | 11/1985 |
| FR | 2 696 584 | 4/1994 |

* cited by examiner

FLEXIBLE TUNNEL FOR A CONNECTION TERMINAL AND TERMINAL COMPRISING ONE SUCH TUNNEL

TECHNICAL FIELD OF THE INVENTION

The invention relates to a flexible tunnel for connection terminal, said tunnel being made by cutting and bending a metal strip to form a flexible frame delimiting an opening of quadrangular cross section for the insertion of a cable that is to be connected. Said opening is delimited by a first and a second lateral branch extending parallel to one another from a bottom. The first branch is extended by an upper branch closing the one-piece structure of the tunnel, the latter two branches being separated from the second branch by at least one first axial clearance running in the direction of travel of the screw.

The invention also relates to a connection terminal comprising a flexible tunnel.

PRIOR ART

Tunnel-type terminals of the type mentioned generate significant pressure forces when the cable that is to be connected is clamped. These forces in the terminal may be as high as 600 daN, even though one tenth of that value is sufficient to ensure adequate electrical contact pressure to enable current to pass. A high initial force has the advantage of causing the formation of the conductors of the cable, but this force can decrease as the metal of the conductors creeps and deforms over time. This results in an effect whereby the terminals become loose, leading to risks of overheating in the region of the contact zone.

Terminals with a certain degree of flexibility to compensate for any loosening of the screws have already been proposed. Documents FR-A-2696584 and DE-A-19513281 relate to tunnel-type terminals equipped with a compression spring intended to store up a reserve of elastic energy to ensure that the conductor that is to be connected is still correctly retained in the event of a slight unscrewing of the clamping screw.

Document EP 336251 describes a screw terminal having a clamping frame and a fixing yoke which are arranged perpendicular to one another and allow double connection of a contact land and of a wire or cable. A gap is provided between the ends of the open frame.

Document EP1085601 describes a connection terminal able to undergo controlled deformation during the clamping of a cable to a connection land of a switching device, this elastic deformation having the benefit of ensuring a certain clamping compensation in the event of cable creep. However, this deformation of the terminal during the course of clamping gives rise to a certain axial misalignment of the clamping screw. The result of this drawback is that the clamping becomes less effective.

OBJECT OF THE INVENTION

The object of the invention is to create a clamping terminal with a flexible tunnel that permanently guarantees good electrical contact with the cable without using an additional spring inside the tunnel.

According to one embodiment of the tunnel according to the invention, when the tunnel is in an untightened state, the upper branch through which the clamping screw is intended to pass in a perpendicular manner forms a first angle of deformation with a longitudinal axis of the tunnel parallel to the first and second lateral branches. Furthermore, the bottom forms a second angle of deformation with the longitudinal axis of the tunnel.

According to one particular embodiment of the tunnel, the first angle of deformation is greater than 90° and the second angle is preferably less than 90°.

For preference, when the tunnel is in a tightened state, the two angles of deformation are substantially equal to 90°.

According to one particular embodiment of the tunnel, the second lateral branch has an end which projects from the upper branch supporting the screw, and comprises a rectangular orifice into which an extension of said upper branch engages.

Advantageously, the terminal extension bears against the lower edge of the rectangular orifice, being separated from the upper edge by the first axial clearance when the terminal is in the untightened state.

For preference, the second transverse clearance is provided between the internal face of the second lateral branch and the base of the extension.

For preference, the terminal extension of the upper branch takes the form of a tenon having an end extending substantially parallel to the second lateral branch.

For preference, the end of the branch has a deformation running as close as possible to the clamping screw, said deformation making it possible to prevent the end from slipping on an external radius of the extension at the end of tightening.

The connection terminal according to the invention comprises a clamping screw housed in a tapped hole formed in the upper branch of the flexible tunnel, said screw has a longitudinal axis perpendicular to said branch and is intended to clamp a cable between a clamping pad secured to said screw and a connection land.

According to one development, the clamping pad secured to one end of the clamping screw is secured to a mobile screen, a mobile assembly formed by said pad and said screen tending to move closer to the bottom of the tunnel at the time of the tightening phase.

For preference, the mobile screen is positioned parallel to one of the two faces for accessing the tunnel and is able to close off, in part, the opening of the tunnel.

BRIEF DESCRIPTION OF THE DRAWINGS

Other advantages and features will become more clearly apparent from the following description of one embodiment of the invention which is given by way of nonlimiting example and depicted in the attached drawings in which.

DESCRIPTION OF ONE PREFERRED EMBODIMENT

Figure 1:
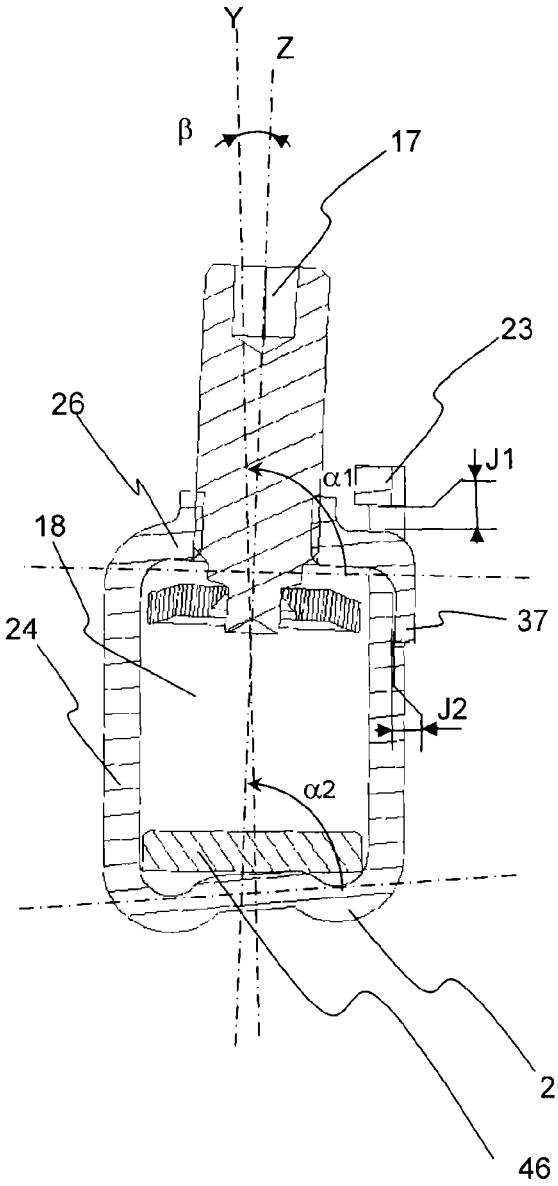
FIG. 1 is an elevation of the connection terminal with flexible tunnel according to the invention, the terminal being in the untightened state.
Figure 2:
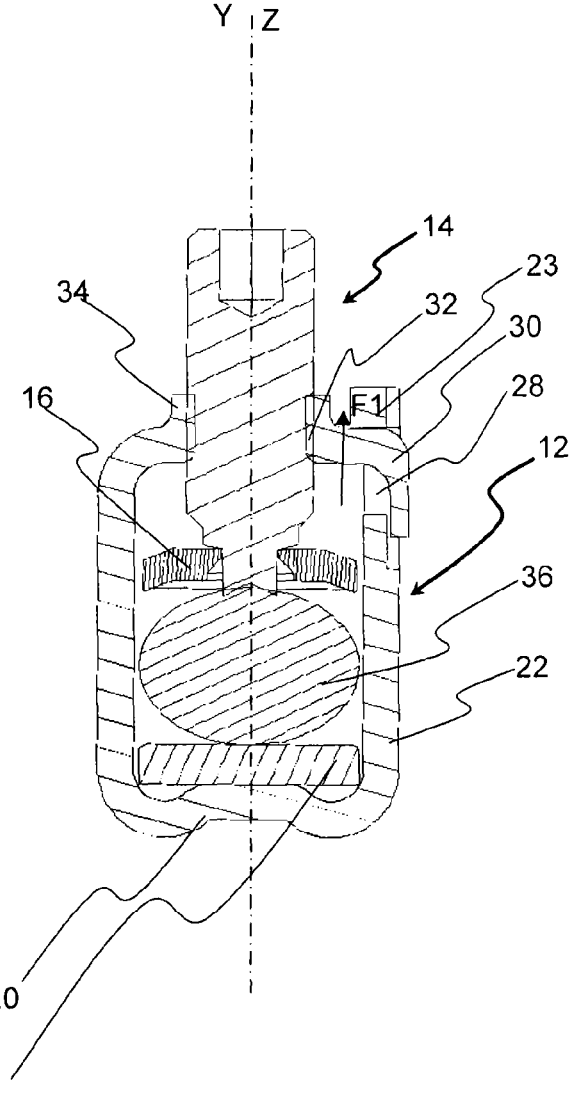
FIG. 2 depicts a view identical to FIG. 1 when the terminal is in the tightened state, with an electrical cable positioned against a connection land.

With reference to FIGS. 1 and 2, a connection terminal comprises a tunnel 12, a clamping screw 14. The connection terminal is intended to make the electrical connection between a connection land 46, notably of a switching device, and an electric cable 36.

The tunnel 12 has a one-piece structure produced by cutting and folding a conducting metal strip, so as to form a frame of substantially quadrangular cross section. The inside of the tunnel 12 is provided with an opening 18 opening onto two faces via which said tunnel can be accessed. The opening is delimited by a bottom 20. Extending from the bottom 20 are two lateral branches 22, 24 running parallel to one another. Moreover, the two branches run substantially parallel to a longitudinal axis Y of the tunnel 12.

A first branch 24 is extended by an upper branch 26 through which the clamping screw 14 passes. The clamping screw 14 extends perpendicular to the upper branch 26. The clamping screw 14 has a longitudinal axis Z.

A branch 26 positioned at the opposite end to the bottom 20 tends to close up the one-piece structure of the tunnel 12.

The second lateral branch 22 is provided at the upper part with an orifice 28 in which a terminal extension 30 of the upper branch 26 engages. The orifice is preferably rectangular. The terminal extension 30 of the upper branch 26 takes the form of a tenon. According to one particular embodiment, said tenon has the particular feature of having an end 37 which extends substantially parallel to the lateral branch 22.

The screw 14 is housed in a tapped hole 32 formed in a collar 34 of the upper branch 26. The clamping screw 14 has a first end positioned outside the tunnel and having a socket 17 intended to collaborate with a tightening tool. The clamping screw 14 has a second end positioned inside the tunnel 12. A clamping pad 16 is fixed to the second end of the clamping screw 14. The connection land 46 is positioned against the bottom 20 of the flexible tunnel 12.

The metal clamping pad 16 is housed in the opening 18 of the tunnel 12 while running parallel to the branch 26, and is intended to clamp the cable 36 against the connection land 46 when the screw 14 is tightened. The clamping pad 16 is made of copper or, preferably, of steel.

Because the tunnel 12 is fixed relative to the casing of a switching device, the clamping pad 16 secured to the end of the threaded shank of the screw 14 moves translationally in the opening 18 as the screw 14 is turned. If the screw 14 is tightened, the clamping pad 16 moves closer to the fixed connection land 46 and to the bottom 20, causing the cable 36 to be clamped against this land.

According to a preferred development of the invention, the tunnel 12 has two extreme operating positions.

As depicted in FIG. 1, the tunnel 12 is in a first operating position, which first position is referred to as the untightened position. This first, untightened, position is defined when the clamping screw 14 is applying no clamping torque to an electric wire 36.

As depicted in FIG. 2, the tunnel 12 is in a second operating position, this second position being referred to as the tightened position. This second, tightened, position is defined when the clamping screw 14 is applying a nominal clamping torque to the electric wire 36.

The flexible tunnel 12 has the particular feature of deforming elastically between these two operating positions.

In the first operating position (the untightened state), the longitudinal axis Z of the clamping screw 14 is not aligned with the longitudinal axis Y of the tunnel 12 defined by the first and second parallel lateral branches 22, 24. In other words, the upper branch 26 is not perpendicular to the first and second lateral branches 22, 24. What happens is that the upper branch 26 forms a first angle of deformation $\alpha 1$ with the longitudinal axis of the tunnel 12. Furthermore, the bottom 20 forms a second angle of deformation $\alpha 2$ with the longitudinal axis of the tunnel 12.

According to one particular embodiment, the first angle of deformation $\alpha 1$ is preferably greater than 90° and the second angle $\alpha 2$ is preferably less than 90°.

In the second operating position (tightened state), the longitudinal axis Z of the clamping screw 14 is aligned with the longitudinal axis Y of the tunnel 12 defined by the first and second parallel lateral branches 22, 24. In other words, the upper branch 26 is perpendicular to the lateral branches 22, 24. What happens is that the first angle of deformation $\alpha 1$ is then equal to 90°. Further, the bottom 20 is also perpendicular to the first and second lateral branches 22, 24. The second angle of deformation $\alpha 2$ is also equal to 90°.

According to the invention, the end of the second lateral branch 22 has an end 23 which projects with respect to the upper branch 26. The terminal extension 30 of the upper branch 26 rests on the lower edge of the rectangular orifice 28, being separated from the upper edge by a first axial clearance J1 when the terminal 10 is in the untightened state (FIG. 1). A second, transverse, clearance J2 is provided between the internal face of the second branch 22 and the base of the extension 30, so as to allow the tunnel 12 some elastic deformation as the screw 14 is tightened.

Figure 3:
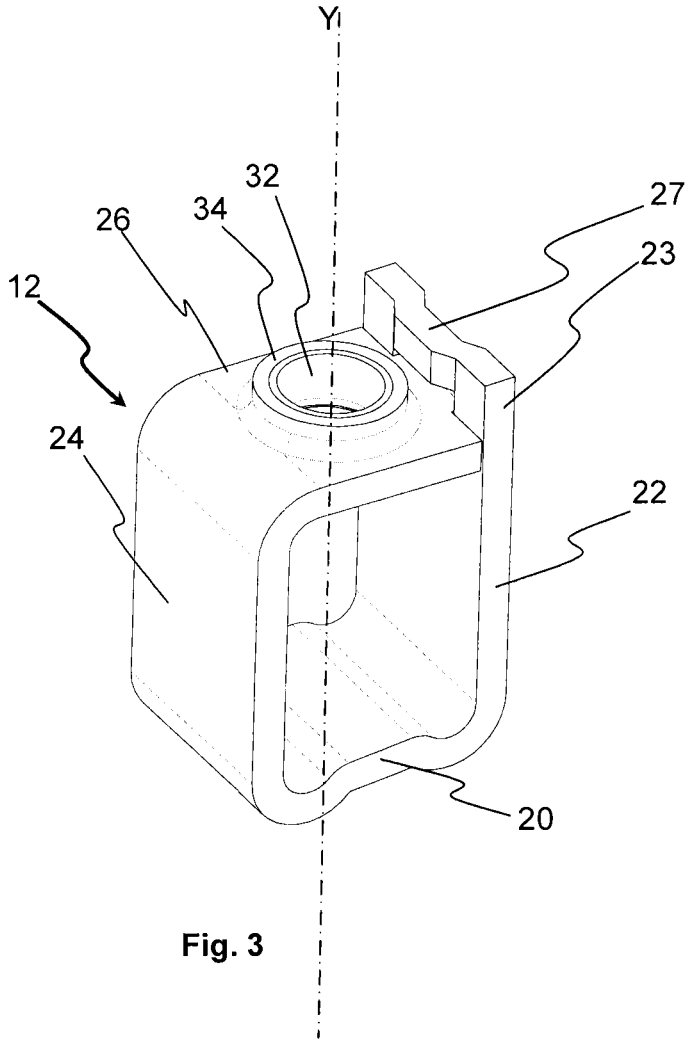
FIG. 3 shows a perspective view of the tunnel of the terminal according to FIG. 1.
Figure 4:
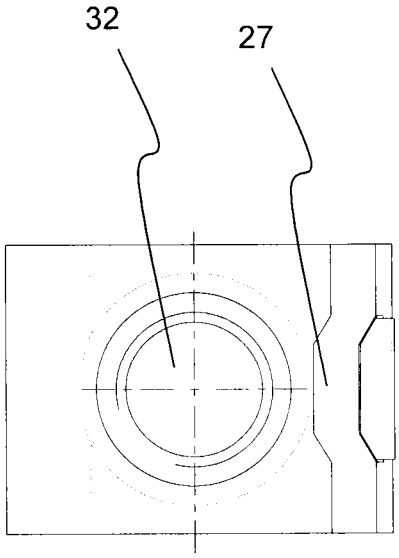
FIG. 4 shows a view of the tunnel according to FIG. 3, from above.

According to one particular embodiment as depicted in FIGS. 3 and 4, the end 23 of the second branch 22 comprises a deformation 27 extending as close as possible to the clamping screw 14. This deformation 27 makes it possible to prevent the end 23 from slipping on the external radius of the extension 30 at the end of tightening when the clamping forces applied to the tunnel 12 are very high.

During the phase of connecting up a cable 36, which phase is illustrated in FIG. 2, actuation of the screw 14 causes, at the start of tightening, elastic deformation of the tunnel 12 following the raising of the terminal extension 30 indicated by the arrow F1. This raising movement is possible because of the presence of the clearances J1 and J2, and ceases as soon as the terminal extension 30 comes into abutment against the upper edge of the rectangular orifice 28. The axial clamping force in the tunnel 12 is relatively modest during the elastic deformation, and lies around a first clamping threshold that falls within a range from 10 to 60 daN. The first clamping threshold S1 is reached when the relative displacement of the screw 14 with respect to the tapping of the hole 32 corresponds to the magnitude of the first clearance J1. According to one embodiment, the first clearance J1 is preferably of the order of 1.6 mm. This first clamping threshold S1 is entirely suitable for the passage of current between the connection land 46 and the cable 36.

When the tightening of the screw 14 is continued after the extension 30 has come into abutment, the tunnel 12 becomes more rigid, and the axial tensile force in the terminal 10 increases rapidly. Depending on the torque exerted on the screw 14, an intermediate degree of clamping somewhere between the first threshold S1 and a second max threshold S2 of 600 daN is then obtained.

The deformation of the tunnel 12 during this second phase of tightening is less than the elastic deformation caused during the take-up of the first clearance J1. According to this embodiment, the deformation is very little, or even non-existent.

Furthermore, as soon as the first clearance J1 has been taken up, the tunnel deforms in such a way that the longitudinal axis Z of the clamping screw 14 coincides with the longitudinal axis Y of the tunnel 12. An axial deformation angle $\beta$ between the two longitudinal axes Y and Z tends to disappear. Regions of connection between the bottom 20 and the first and second lateral branches 22, 24 deform in such a way that the bottom 20 ultimately becomes perpendicular to the two branches. The conducting connection land 46 sandwiched between the bottom 20 and the electric cable 36 thus finds itself lying on a flat surface. This laying flat allows good exchange of heat between the cable 36 and the connection land 46 positioned against the bottom 20 of the tunnel 12. This laying flat thus makes it possible to reduce the heating caused by the passage of current. Further, the tunnel 12 also experiences deformation at the connection points between the upper branch 26 and the two lateral branches 22, 24. Said upper branch 26 is ultimately perpendicular to the two branches. The tunnel thus has a substantially rectangular profile.

The deformation of the tunnel 12 during the screwing-in of the screw 14 results in a double-gradient spring function. In the event of loosening following the compaction and creep of the conductors of the cable 36, the axial force in the tunnel 12 decreases and is returned toward the first threshold S1. This elastic reserve nonetheless remains sufficient to maintain correct contact between the land 46 and the cable 36.

In both of the embodiments of FIGS. 1 to 6, the first axial clearance J1 suited to the elastic deformation of the tunnels 12 extends in the direction of travel of the screw 14.

Figure 5:
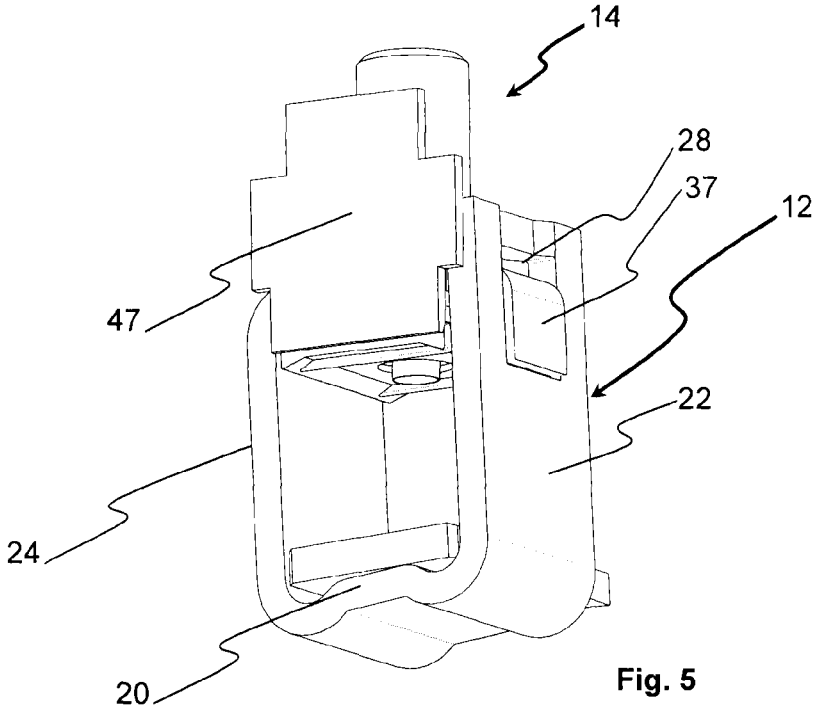
FIG. 5 shows a perspective view of an alternative form of embodiment of the terminal according to FIG. 1.
Figure 6A:
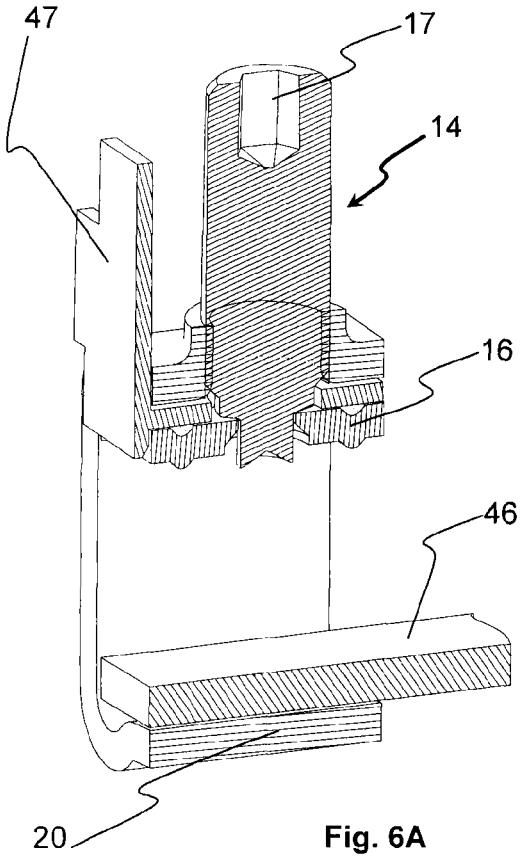
FIGS. 6A and 6B show sectioned views of the terminal according to FIG. 5 in various operating positions.
Figure 6B:
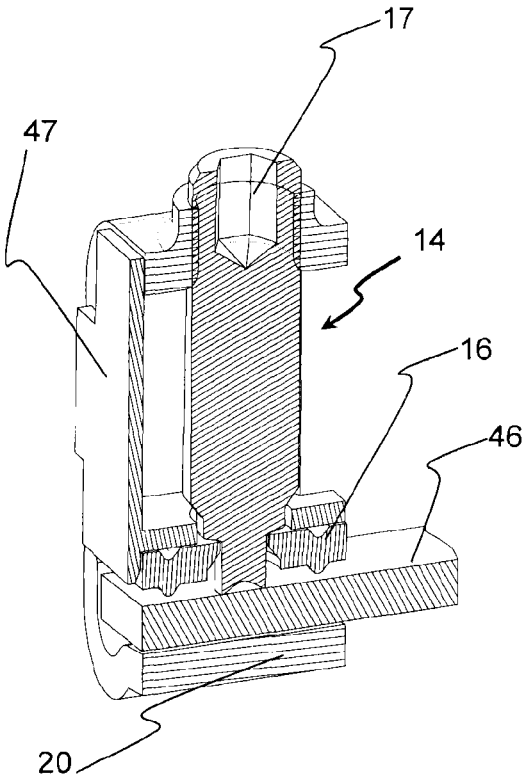

According to an alternative form of embodiment as depicted in FIGS. 5 and 6, the clamping pad 16 associated with the clamping screw 14 is secured to a mobile screen 47. A mobile assembly formed by said pad and said screen tends to move closer to the bottom 20 at the time of the tightening phase. The mobile screen 47, positioned parallel to one of the two faces for access to the tunnel 12, is then able in part to close off the opening 18 of the tunnel 12. In other words, access to the cable 36 is thus minimized by the presence of the mobile screen 47 in front of one face via which the tunnel 12 is accessed.

The invention claimed is:

1. A flexible tunnel for a connection terminal, said tunnel being made by cutting and bending a metal strip to form a flexible frame delimiting an opening of quadrangular cross section for the insertion of a cable that is to be connected, said opening being delimited by a first and a second lateral branch extending parallel to one another from a bottom, the first branch being extended by an upper branch closing the one-piece structure of the tunnel, the latter two branches being separated from the second branch by at least one first axial clearance running in a direction of travel of a clamping screw, wherein, when the tunnel is in an untightened state, the upper branch through which the clamping screw is intended to pass in a perpendicular manner forms a first angle of deformation with a longitudinal axis of the tunnel parallel to the first and second lateral branches, and the bottom forms a second angle of deformation with the longitudinal axis of the tunnel.

2. The flexible tunnel according to claim 1, wherein the first angle of deformation is greater than 90°.

3. The flexible tunnel according to claim 1, wherein, when the tunnel is in a tightened state, the two angles of deformation are substantially equal to 90°.

4. The flexible tunnel according to claim 1, wherein the second lateral branch has an end which projects from the upper branch supporting the screw, and comprises a rectangular orifice into which a terminal extension of said upper branch engages.

5. The flexible tunnel according to claim 4, wherein the terminal extension bears against the lower edge of the rectangular orifice, being separated from the upper edge by the first axial clearance when the terminal is in the untightened state.

6. The flexible tunnel according to claim 5, wherein a second transverse clearance is provided between the internal face of the second lateral branch and the base of the extension.

7. The flexible tunnel according to claim 4, wherein the terminal extension of the upper branch takes the form of a tenon having an end extending substantially parallel to the second lateral branch.

8. The flexible tunnel according to claim 4, wherein the end of the branch has a deformation running as close as possible to the clamping screw, said deformation making it possible to prevent the end from slipping on an external radius of the extension at the end of tightening.

9. A connection terminal comprising:

a flexible tunnel according to claim 1; and a clamping screw housed in a tapped hole formed in the upper branch of the flexible tunnel, said screw having a longitudinal axis perpendicular to said upper branch to clamp a cable between a clamping pad secured to said screw and a connection land positioned on the bottom of the tunnel.

10. The flexible tunnel according to claim 1, wherein the second angle of deformation is less than 90°.

11. The flexible tunnel according to claim 1, wherein the first angle of deformation is greater than 90° and the second angle of deformation is less than 90°.

12. A connection terminal according to comprising:

a flexible tunnel being made by cutting and bending a metal strip to form a flexible frame delimiting an opening of quadrangular cross section for the insertion of a cable that is to be connected, said opening being delimited by a first and a second lateral branch extending parallel to one another from a bottom, the first branch being extended by an upper branch closing the one-piece structure of the tunnel, the latter two branches being separated from the second branch by at least one first axial clearance running in the direction of travel of a clamping screw, wherein, when the tunnel is in an untightened state, the upper branch through which the clamping screw is intended to pass in a perpendicular manner forms a first angle of deformation with a longitudinal axis of the tunnel parallel to the first and second lateral branches, and in that the bottom forms a second angle of deformation with the longitudinal axis of the tunnel; and the clamping screw is housed in a tapped hole formed in the upper branch of the flexible tunnel, said screw having a longitudinal axis perpendicular to said upper branch to clamp a cable between a clamping pad secured to said screw and a connection land positioned on the bottom of the tunnel, wherein the clamping pad secured to one end of the clamping screw is secured to a mobile screen, a mobile assembly formed by said pad and said screen tending to move closer to the bottom at the time of the tightening phase.

13. The connection terminal according to claim 12, wherein the mobile screen is positioned parallel to one of the two faces for accessing the tunnel and is able to close off, in part, the opening of the tunnel.

* * * * *